US007183702B2

(12) United States Patent
Kanao et al.

(10) Patent No.: US 7,183,702 B2
(45) Date of Patent: Feb. 27, 2007

(54) SPARK PLUG WITH HIGH INSULATION PROPERTIES AND HIGH CAPABILITY TO IGNITE AIR-FUEL MIXTURE

(75) Inventors: Keiji Kanao, Aichi-ken (JP); Shinichi Okabe, Aichi-ken (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 102 days.

(21) Appl. No.: 11/046,247

(22) Filed: Jan. 31, 2005

(65) Prior Publication Data

US 2005/0168120 A1 Aug. 4, 2005

(30) Foreign Application Priority Data

Jan. 30, 2004 (JP) ..... 2004-023015
Nov. 10, 2004 (JP) ..... 2004-326659

(51) Int. Cl.
*F02M 57/06* (2006.01)
*H01T 13/20* (2006.01)

(52) U.S. Cl. ..... 313/118; 313/143

(58) Field of Classification Search ..... 313/118–145; 445/7; 123/169 R, 169 EL
See application file for complete search history.

(56) References Cited

U.S. PATENT DOCUMENTS 6,566,793 B2 * 5/2003 Honda et al. ..... 313/141
6,628,050 B1 * 9/2003 Kameda et al. ..... 313/143
6,653,768 B2 11/2003 Kato et al. ..... 313/143
2002/0140333 A1 10/2002 Kato et al. ..... 313/143
2003/0155849 A1 * 8/2003 Hori ..... 313/141

FOREIGN PATENT DOCUMENTS

JP 5-55490 7/1993
JP 2002-260817 9/2002

* cited by examiner

*Primary Examiner*—Mariceli Santiago
*Assistant Examiner*—Anne M Hines
(74) *Attorney, Agent, or Firm*—Nixon & Vanderhye PC

(57) ABSTRACT

A spark plug according to the invention includes a metal shell that has a threaded portion with an outer diameter of 10 mm or less, or equal to 12 mm, an insulator, a center electrode, and a ground electrode. The spark plug has an improved structure in which an end portion of the insulator tapers toward an end thereof that protrudes from an end of the metal shell, and dimensional parameters, including a space G of the spark gap in the spark plug, a taper degree of the end portion of the insulator that is represented by an outer diameter difference (D–D0) in the end portion, and a size T0 of the air pocket formed in the spark plug, each have an effective range determined based on the experimental investigation results from the inventors. The structure ensures high insulation properties and high ignition capability of the spark plug.

24 Claims, 13 Drawing Sheets

SPARK PLUG WITH HIGH INSULATION PROPERTIES AND HIGH CAPABILITY TO IGNITE AIR-FUEL MIXTURE

CROSS-REFERENCE TO RELATED APPLICATION

This application claims priority from Japanese Patent Applications No. 2004-23015, filed on Jan. 30, 2004, and No. 2004-326659, filed on Nov. 10, 2004, the contents of which are hereby incorporated by reference into this application.

BACKGROUND OF THE INVENTION

1. Technical Field of the Invention

The present invention relates generally to spark plugs for internal combustion engines. More particularly, the invention relates to a spark plug with an improved structure in which a metal shell has a threaded portion with an outer diameter of 12 mm or less. The improved structure ensures the spark plug of high insulation properties and a high capability to ignite the air-fuel mixture (referred to as ignition capability hereinafter).

2. Description of the Related Art

Conventional spark plugs for use in internal combustion engines generally include a tubular metal shell, an insulator, a center electrode, and a ground electrode.

The metal shell has a threaded portion for fitting the spark plug into a combustion chamber of the engine. The insulator has a center bore formed therein and is fixed in the metal shell such that an end thereof protrudes from an end of the metal shell. The center electrode is so secured in the center bore of the insulator that an end thereof protrudes from the end of the insulator. The ground electrode has a tip portion and is joined to the end of the metal shell such that the tip portion faces the end of the center electrode through a spark gap therebetween.

In recent years, the demand for higher power output of internal combustion engines has required increasing the sizes of intake and exhaust valves for the engine and securing a water jacket for cooling of the engine. This results in a decreased space available for installing a spark plug in the engine, thus requiring the spark plug to have a compact (more specifically, slenderized) structure.

Specifically, the threaded portion of the metal shell in a spark plug had an outer diameter of M14 as specified in JIS (Japanese Industrial Standards) in the past; however, the threaded portion is now required to have an outer diameter of M12 or less as specified in JIS.

For example, Japanese Unexamined Utility Model Publication No. H5-55490 discloses such a compact spark plug.

In a slenderized spark plug, the volume of an air pocket, which is the insulation space between an outer surface of the insulator and an inner surface of the metal shell, is accordingly reduced.

The insulator generally includes an intermediate portion and an end portion that includes the end of the insulator protruding from the metal shell. The end portion is thinner than the intermediate portion, and there is provided a frustoconical shoulder between the two portions. The shoulder engages with an annular seat of the metal shell, which is formed on the inner surface of the metal shell, through a gasket so as to establish a gas-tight seal. Accordingly, the air pocket formed in the spark plug has a range in the lengthwise direction of the insulator from the end of the metal shell to the place where the shoulder of the insulator and the annular seat of the metal shell are in sealing engagement.

When the volume of the air pocket is reduced for slenderizing the spark plug, "inside sparks" can be generated instead of normal sparks to be generated in the spark gap. The inside sparks here denote sparks which creep from the center electrode of the spark plug along the outer surface of the insulator, and jump to the metal shell across the air pocket formed between the insulator and the metal shell. The inside sparks may lead to misfires, thereby resulting in efficiency drop of the engine.

On the other hand, high compression or lean burn engines have recently been used for the purpose of increasing power output and improving fuel economies. However, when the combustion condition of such an engine worsens, carbon and other unburned products will deposit on the outer surface of the end portion of the insulator, thus causing a problem of "carbon fouling".

When the insulator of a spark plug is fouled with carbon, the above-described inside sparks can be more easily generated in the spark plug. This is because the electrically conductive carbon deposit on the outer surface of the insulator end portion causes a drop in the insulation resistance between the insulator and the metal shell.

Thus one may consider, for the purpose of preventing such a drop in the insulation resistance between the insulator and the metal shell, reducing the volume of the air pocket so as to reduce the amount of carbon and other unburned products to flow into the air pocket and deposit on the outer surface of the insulator end portion.

However, at the same time, the reduced volume of the air pocket will cause, as described previously, generation of inside sparks even when the insulator end portion has not been fouled with carbon.

SUMMARY OF THE INVENTION

It is, therefore, a primary object of the present invention to provide a spark plug with an improved structure in which a metal shell has a threaded portion with an outer diameter of 12 mm or less; the improved structure can ensure the spark plug of high insulation properties and a high ignition capability.

To this end, it is required to prevent the insulator of the spark plug from being fouled with carbon, thereby preventing drop in the insulation resistance between the insulator and the metal shell thereof and generation of inside sparks in the spark plug.

The inventors of the invention have considered that it can be effective, in hindering the carbon flow into the air pocket of the spark plug, to increase the taper degree of the outer surface of the insulator. More specifically, when the outer surface of the end portion of the insulator is highly tapered, the carbon flowing into the air pocket will collide against the outer surface of the end portion, thereby changing the flow course. As a result, it becomes difficult for the carbon to deposit on the outer surface of the insulator end portion.

The present invention results from the experimental investigation results based on the above consideration.

According to the present invention, a spark plug is provided which includes:

a tubular metal shell having a first end and a second end opposed to the first end, the metal shell also having a threaded portion on an outer periphery thereof and an annular seat formed on an inner surface of the metal shell, the threaded portion having an outer diameter of 10 mm or less;

a hollow insulator having a length with a first length portion, a second length portion, and a shoulder provided between the first and second length portions, the shoulder having an outer surface that tapers and continues to an outer surface of the first length portion, the insulator being fixed in the metal shell such that the shoulder of the insulator and the annular seat of the metal shell are in sealing engagement through a gasket, the first length portion of the insulator having an end protruding from the first end of the metal shell;

a center electrode secured in the insulator, the center electrode having an end protruding from the end of the first length portion of the insulator; and a ground electrode joined to the first end of the metal shell, the ground electrode having a tip portion that faces the end of the center electrode through a spark gap, wherein the first length portion of the insulator tapers toward the end thereof to have a first outer diameter on a first reference plane and a second outer diameter on a second reference plane, the first reference plane being defined to extend perpendicular to a lengthwise direction of the insulator through an intersection between a first reference straight-line having a section on the outer surface of the shoulder and a second reference straight-line having a section on the outer surface of the first length portion of the insulator, the second reference straight-line being so defined that the first length portion of the insulator has a maximum outer diameter on the section of the second reference straight-line, the second reference plane being defined to extend parallel to the first reference plane through an inner edge of the first end of the metal shell, wherein the following dimensional relationships are defined:

$$D-D0 \geqq 1.0 \text{ mm};$$

$$T0 \geqq 1.2 \text{ mm; and}$$

$$G \leqq 0.9 \text{ mm, where}$$

D is the first outer diameter of the first length portion of the insulator on the first reference plane, D0 is the second outer diameter of the first length portion of the insulator on the second reference plane, T0 is a distance between the inner surface of the metal shell and the outer surface of the insulator on the second reference plane, and G is a space of the spark gap between the end of the center electrode and the tip portion of the ground electrode.

Specifying the effective ranges of the taper degree of the outer surface of the first length portion of the insulator (i.e., D−D0), the air pocket size (i.e., T0), and the space of the spark gap (i.e., G) for the spark plug as above, the insulation resistance of the spark plug is secured, while preventing generation of inside sparks.

To completely suppress the generation of inside sparks in the spark plug, it is preferable that D−D0≧1.5 mm.

To further reliably prevent carbon deposit on the outer surface of the first length portion of the insulator, the following dimensional relationship is preferably defined for the spark plug:

$$1.0 \text{ mm} \leqq (D3-D0) \leqq 1.8 \text{ mm},$$

where D3 is an outer diameter of the first length portion of the insulator on a third reference plane that is defined to extend parallel to and spaced a distance of 3×T0 from the first reference plane.

For the same purpose, it is also preferable to define the following dimensional relationship for the spark plug:

$$(D4-D0) \leqq 0.8 \text{ mm},$$

where D4 is an outer diameter of the first length portion of the insulator on a fourth reference plane that is defined to extend parallel to and spaced a distance of 1.5×T0 from the first reference plane.

The spark plug according to the invention exhibits excellent performance in insulation properties and in ignition capability particularly when the threaded portion of the metal shell has an outer diameter equal to 10 mm.

To further reliably prevent carbon deposit on the outer surface of the first length portion of the insulator, it is preferable for the spark plug that an inner diameter of the metal shell is constant, or increases along the lengthwise direction of the insulator in a range from the second reference plane to the third reference plane.

Furthermore, it is preferable that the center electrode of the spark plug includes a noble metal chip, an end of which represents the end of the center electrode. The noble metal chip of the center electrode has a cross-sectional area perpendicular to the lengthwise direction of the insulator in a range of 0.07 to 0.40 $mm^2$.

Using such a noble metal chip, the space available for ignition in the spark gap of the spark plug is secured, while the noble metal chip is not too thin to be easily worn down.

The noble metal chip of the center electrode is made, preferably, of an Ir-based alloy including Ir in an amount of greater than 50 weight percent and at least one additive; the Ir-based alloy has a melting point of greater than 2000 degrees Celsius. Furthermore, the at least one additive is preferably selected from Pt, Rh, Ni, W, Pd, Ru, Re, Al, $Al_2O_3$, Y, $Y_2O_3$.

Specifying the material of the noble chip as above, a long service life is secured for the center electrode of the spark plug.

It is also preferable that the tip portion of the ground electrode of the spark plug includes a noble metal chip that has a cross-sectional area perpendicular to the lengthwise direction of the insulator in a range of 0.12 to 0.80 $mm^2$, and a length in the lengthwise direction of the insulator in a range of 0.3 to 1.5 mm. At the same time, the following dimensional relationship is defined:

$$G \geqq 0.6 \text{ mm}.$$

Using such a noble metal chip of the ground electrode, the space available for ignition in the spark gap of the spark plug is secured while the noble metal chip is not too thin to be easily worn down, thereby allowing the space G of the spark gap to be reduced to the considerably small size of 0.6 mm.

The noble metal chip of the ground electrode is made, preferably, of a Pt-based alloy including Pt in an amount of greater than 50 weight percent and at least one additive; the Pt-based alloy has a melting point of greater than 1500 degrees Celsius. Furthermore, the at least one additive is preferably selected from Ir, Rh, Ni, W, Pd, Ru, Re.

Specifying the material of the noble chip of the ground electrode as above, a long service life is secured for the ground electrode.

When a spark plug has a structure almost identical to that of the above-described one according to the invention but the outer diameter of the threaded portion of the metal shell equal to 12 mm, the following dimensional relationships are defined therefor according to the invention:

$D-D0 \geqq 1.4$ mm;

$T0 \geqq 1.6$ mm; and $G \leqq 1.1$ mm.

Specifying the dimensional relationships for the spark plug having the outer diameter of 12 mm as above, the insulation resistance of the spark plug is secured, while preventing generation of inside sparks.

Further, to completely suppress generation of inside sparks in the spark plug having the outer diameter of 12 mm, it is preferable that $D-D0 \geqq 1.6$ mm.

Accordingly, the improved structure of the spark plug according to the present invention ensures the spark plug of high insulation properties and a high ignition capability.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
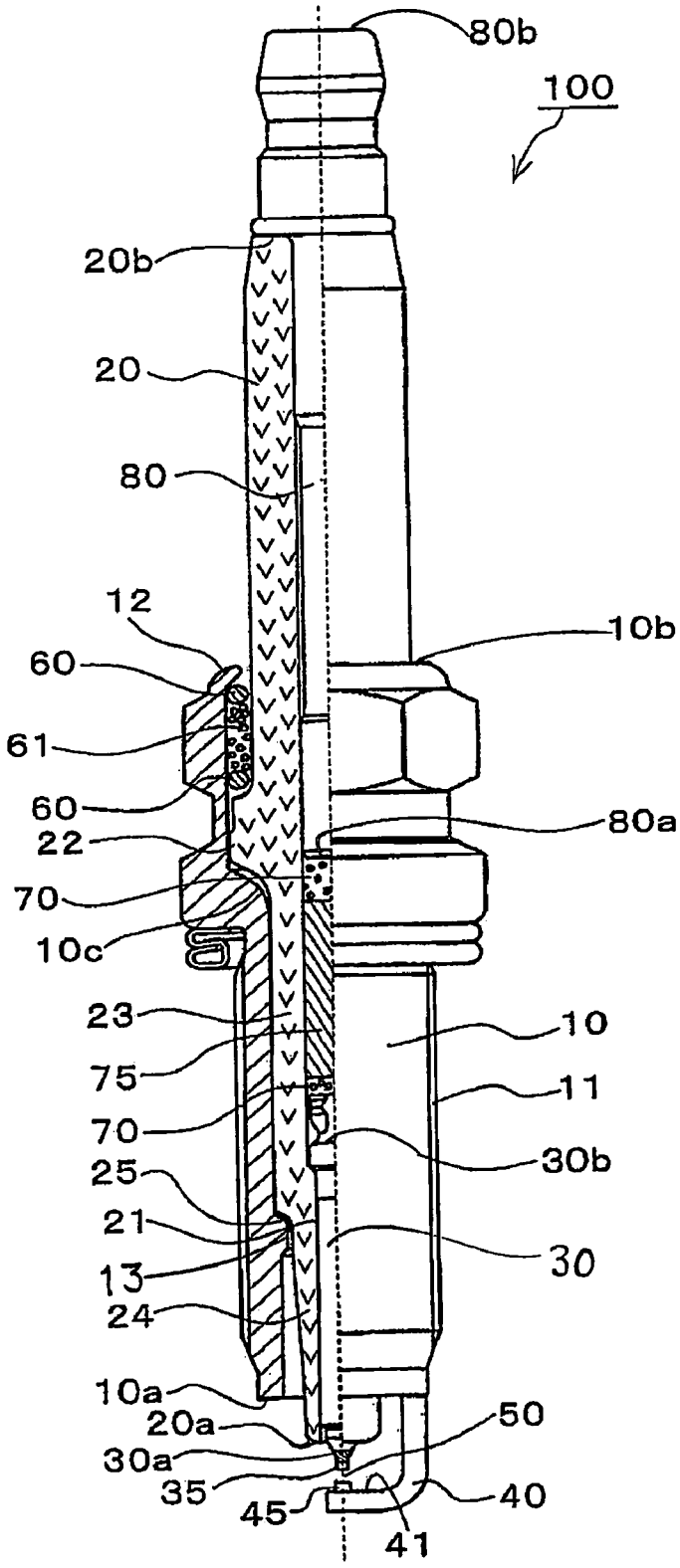
FIG. 1 is a partially cross-sectional side view showing an overall structure of a spark plug according to an embodiment of the invention.

The preferred embodiments of the present invention will be described hereinafter with reference to FIGS. 1–14.

It should be noted that, for the sake of clarity and understanding, identical components having identical functions have been marked, where possible, with the same reference numerals in each of the figures.

FIG. 1 shows an overall structure of a spark plug 100 according to an embodiment of the invention.

The spark plug 100 is designed for use in internal combustion engines of automotive vehicles. The installation of the spark plug 100 in an internal combustion engine is achieved by fitting it into a combustion chamber (not shown) of the engine through a threaded bore provided in the engine head (not shown).

As shown in FIG. 1, the spark plug 100 essentially includes a metal shell 10, an insulator 20, a center electrode 30, and a ground electrode 40.

The tubular metal shell 10 is made of a conductive metal material, for example low-carbon steel. The metal shell 10 has a threaded portion 11 on the outer periphery thereof for fitting the spark plug 100 into the combustion chamber of the engine as described above.

The threaded potion 11 of the metal shell 10 has an outer diameter of 12 mm or less. This range corresponds to the range of M12 or less as specified in JIS (Japanese Industrial Standards).

The insulator 20, which is made of alumina ceramic ($Al_2O_3$), is fixed and partially contained in the metal shell 10 such that an end 20*a* of the insulator 20 protrudes from an end 10*a* of the metal shell 10 while the other end 20*b* of the insulator 20 protrudes from the other end 10*b* of the metal shell 10.

The cylindrical center electrode 30 is made of a highly heat conductive metal material such as Cu as the core material and a highly heat-resistant, corrosion-resistant metal material such as a Ni (Nickel)-based alloy as the clad material.

The center electrode 30 is secured in a center bore 21 of the insulator 20, so that it is electrically isolated from the metal shell 10. The center electrode 30 is partially included in the metal shell 10 together with the insulator 20 such that an end 30*a* of the center electrode 30 protrudes form the end 20*a* of the insulator 20.

The ground electrode 40, which is made of a Ni-based alloy consisting mainly of Ni, is column-shaped, for example an approximately L-shaped prism in this embodiment.

The ground electrode 40 is joined, for example by welding, to the end 10*a* of the metal shell 10. The ground electrode 40 has a tip portion including a side surface 41 that faces the end 30*a* of the center electrode 30 through a spark gap 50.

Figure 2:
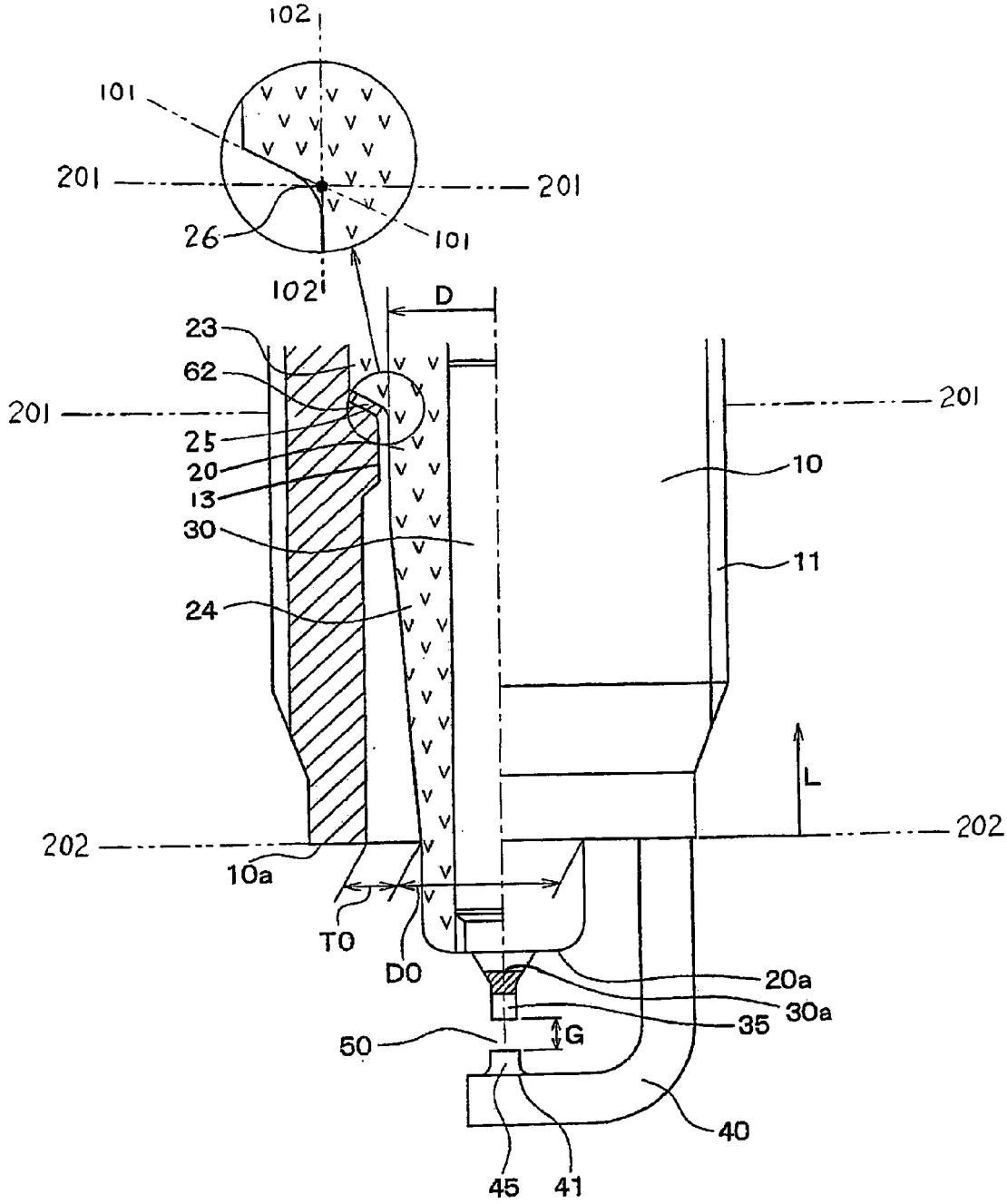
FIG. 2 is an enlarged partially cross-sectional side view showing a spark gap and the proximity thereof in the spark plug of FIG. 1.

Referring now to FIG. 2, the spark plug 100 is further provided with a first noble metal chip 35 and a second noble metal chip 45, both of which have a cylindrical shape.

The first noble metal chip 35 and the second noble metal chip 45 are, as shown in FIG. 2, spaced from each other so as to form the spark gap 50 therebetween. The spark gap 50 has a space G, the range of which will be described below.

The first noble metal chip 35, which serves as a sparking member of the spark plug 100, is joined to the end 30*a* of the center electrode 30 by laser welding.

The cylindrical first noble metal chip 35 has a cross-sectional area perpendicular to the axis thereof, preferably, in the range of 0.07 to 0.4 $mm^2$.

Using such a noble metal chip, the space available for ignition in the spark gap 50 of the spark plug 100 is secured, while the first noble metal chip 35 is not too thin to be easily worn down.

The first noble metal chip 35 is made, preferably, of an Ir (Iridium)-based alloy including Ir in an amount of greater than 50 weight percent and at least one additive; the melting point of the Ir-based alloy is greater than 2000 degrees Celsius.

Furthermore, the at least one additive is preferably selected from Pt (Platinum), Rh (Rhodium), Ni, W (Tungsten), Pd (Palladium), Ru (Ruthenium), Re (Rhenium), Al (Aluminum), $Al_2O_3$ (Alumina), Y (Yttrium), $Y_2O_3$ (Yttria).

Specifying the material of the first noble chip 35 as above, a long service life is secured for the first noble chip 35.

The second noble metal chip 45, which also serves as a sparking member of the spark plug 100, is joined to the side surface 41 of the ground electrode 40 by laser welding.

The cylindrical second noble metal chip 45 has a cross-sectional area perpendicular to the axis thereof, preferably, in the range of 0.12 to 0.80 $mm^2$.

The distance between the end of the second noble metal chip 45 facing the spark gap 50 and the side surface 41 of the ground electrode 40 is, preferably, in the range of 0.3 to 1.5 mm.

Using such a noble metal chip, the space available for ignition in the spark gap 50 of the spark plug 100 is secured while the second noble metal chip 45 is not too thin to be easily worn down, thereby allowing the space G of the spark gap 50 to be reduced to a considerably small size of 0.6 mm.

The second noble metal chip 45 is made, preferably, of a Pt-based alloy including Pt in an amount of greater than 50 weight percent and at least one additive; the melting point of the Pt-based alloy is greater than 1500 degrees Celsius.

Furthermore, the at least one additive for the second noble metal chip 45 is preferably selected from Ir, Rh, Ni, W, Pd, Ru, Re.

Specifying the material of the second noble chip 45 as above, a long service life is secured for the second noble chip 45.

Turning to FIG. 1, there is provided a caulking portion 12 at the end 10*b* of the metal shell 10, so as to fix the insulator 20 in the metal shell 10.

In the caulking portion 12, sealing members 60 and 61 are arranged between the metal shell 10 and the insulator 20 for sealing. More specifically, in the caulking portion 12, the space between two metal rings 60 is filled with talc 61.

The insulator 20 has a flange portion 22 located in the metal shell 10, the outer diameter of which is largest in the insulator 20. With the help of the flange portion 22, it has been possible to arrange the sealing members 60 and 61 as described above.

The insulator 20 also has an intermediate portion 23 that is located in the metal shell 10 adjoining the flange portion 22. The intermediate portion 23 has an outer diameter less than that of the flange portion 22.

The insulator 20 further has an end portion 24 that includes the end 20*a* of the insulator 20. The end portion 24 has an outer diameter less than that of the intermediate portion 23.

Between the intermediate portion 23 and the end portion 24, there is provided a substantially frusto-conical shoulder 25. As shown in FIG. 2, the shoulder 25 has an outer surface that tapers and continues to the outer surface of the end portion 24.

The shoulder 25 engages with an annular seat 13, which is formed on the inner surface of the metal shell 10, through a gasket 62 so as to establish a gas-tight seal in the spark plug 100. The gasket 62 may be a metal ring made, for example, of iron. Such a metal ring is generally used in spark plug constructions.

In the enlarged view of FIG. 2, which is emphasized with a circle in the figure, there is shown a reference point 26. The reference point 26 is defined as an intersection between a first reference straight-line 101 and a second reference straight-line 102. The first reference straight-line 101 has a section on the outer surface of the shoulder 25; while the second reference straight-line 102 has a section on the outer surface of the end portion 24, on which the end portion 24 has a maximum outer diameter.

Further, a first reference plane 201 and a second reference plane 202 are also defined for the sake of explanation. The first reference plane 201 extends perpendicular to the lengthwise direction L of the insulator 20 through the reference point 26; the second reference plane 202 extends parallel to the first reference plane 201 through an inner edge of the end 10*a* of the metal shell 10.

In this embodiment, as shown in FIGS. 1 and 2, the outer diameter of the insulator 20 increases along the lengthwise direction L of the insulator 20 from the second reference plane 202 to the first reference plane 201. This result in a decrease in the distance between the inner surface of the insulator 20 and the outer surface of the metal shell 10 along the direction L in the range of the second reference plane 202 to the first reference plane 201.

In other words, the end portion 24 of the insulator 20 has an outer surface that is tapered from the first reference plane 201 to the second reference plane 202 so that the air pocket, which is formed between the outer surface of the end portion 24 and the inner surface of the metal shell 10, expands accordingly.

Referring again FIG. 1, an end 30*b* of the center electrode 30 is, in the center bore 21 of the insulator 20, electrically connected to an end of a resistive element 75 through a glass sealing material 70 that is electrically conductive.

The other end of the resistive element 75 is electrically connected, through the glass sealing material 70, to an end 80*a* of a cylindrical terminal electrode (i.e., stem) 80.

The terminal electrode 80 is secured in the center bore 21 of the insulator 20 such that the other end 80*b* thereof protrudes from the end 20*b* of the insulator 20, to which an ignition coil boot (not shown) is fixed.

Having described all the essential components of the spark plug 100, the dimensional parameters designated as G, D, D0, and T0 in FIG. 2, the relationships between which are critical to the structure of the spark plug 100, are defined as follows:

G is a space of the spark gap 50 between the first noble metal chip 35 and the second noble metal chip 45 (referred to as a spark gap size G hereinafter);

D is an outer diameter of the end portion 24 of the insulator 20 on the first reference plane 201;

D0 is an outer diameter of the end portion 24 of the insulator 20 on the second reference plane 202; and T0 is a distance between the inner surface of the metal shell 10 and the outer surface of the insulator 20 on the second reference plane 202 (referred to as an air pocket size T0 hereinafter).

The relationships between the above parameters have been determined in light of the following consideration of the inventors.

To ensure high insulation properties and a high ignition capability of the spark plug 100, it is necessary to prevent the insulator 20 of the spark plug 100 from being fouled with carbon, thereby preventing drop in the insulation resistance between the insulator 20 and the metal shell 10 (referred to as the insulation resistance of the spark plug hereinafter) and generation of inside sparks in the air pocket of the spark plug 100.

The inventors of the present invention have conceived that it be effective, in hindering carbon from flowing into the air pocket of the spark plug, to increase the taper degree of the outer surface of the insulator.

More specifically, when the outer surface of the end portion 24 of the insulator 20 is highly tapered, the carbon flowing into the air pocket will collide against the outer surface of the end portion 24, thereby changing the flow course. As a result, it becomes difficult for the carbon to deposit on the outer surface of the end portion 24 of the insulator 20.

For the spark plug 100, the distance between the first reference plane 201 and the second reference plane 202 in the lengthwise direction L of the insulator 20 generally falls on a certain range, for example, of 10 to 15 mm due to various physical or dimensional constraints.

Accordingly, the taper degree of the outer surface of the insulator end portion 24 in the spark plug 100 can be represented merely by the outer diameter difference (D−D0).

The effective ranges of the outer diameter difference (D−D0) and the air pocket size T0 in the spark plug 100 have been determined based on the investigation results from the inventors.

It should be noted that the investigation results to be shown below are particularly for the spark plug 100 that has the threaded portion 11 of the metal shell 10 with an outer diameter of 10 mm; it has been, however, experimentally confirmed that the same tendency and similar results can be observed with spark plugs 100 in which the outer diameter is less than 10 mm (e.g. 8 mm) or equal to 12 mm.

Sample spark plugs of 11 different types S1–S11 were fabricated for the investigation. The detailed values of the above-described parameters for each type are given in TABLE 1.

Among the above sample plug types, the type of S11 had an outer diameter of the threaded portion 11 of the metal shell 10 equal to 14 mm (corresponds to M14 as specified in JIS). This type was a conventional one with typical specifications including the spark gap size G of 1.1 mm, which had been proven in the market.

The other sample plug types S1–S10 each had an outer diameter of the threaded portion 11 equal to 10 mm; in other words, all of them were slenderized.

TABLE 1

(UNIT: mm)

| TYPE | D | D0 | D − D0 | T0 |
|---|---|---|---|---|
| S1 | 3.8 | 2.8 | 1.0 | 1.6 |
| S2 | 5.0 | 2.8 | 2.2 | 1.6 |
| S3 | 3.8 | 3.2 | 0.6 | 1.4 |
| S4 | 4.2 | 3.2 | 1.0 | 1.4 |
| S5 | 4.6 | 3.2 | 1.4 | 1.4 |
| S6 | 5.0 | 3.2 | 1.8 | 1.4 |
| S7 | 3.8 | 3.6 | 0.2 | 1.2 |
| S8 | 4.2 | 3.6 | 0.6 | 1.2 |
| S9 | 5.0 | 3.6 | 1.4 | 1.2 |
| S10 | 5.0 | 4.0 | 1.0 | 1.0 |
| S11 | 6.8 | 5.4 | 1.4 | 1.8 |

For all the slenderized sample plug types, the distance between the first reference plane 201 and the second reference plane 202 in the lengthwise direction L of the insulator 20 was 11 mm; the spark gap size G was given a value of 0.9 mm being less the air pocket size T0 so as to prevent generation of inside sparks. Those slenderized sample plug types were evaluated in comparison with the conventional type of S11.

In the investigation, sample spark plugs of S1–S11 were tested using a test vehicle that had four cylinders, so that four identical sample spark plugs with the same type could be installed in the test vehicle at the same instance.

The test was conducted under a test condition in which the ambient air temperature, water temperature, and oil temperature for the test vehicle were each kept at 20 degrees Celsius, and the applied driving pattern was to continuously repeat acceleration and deceleration of the vehicle in the range of 10 km/h to 20 km/h ten times for each cycle. This driving pattern is such a pattern that can cause the insulators of the spark plugs installed in the vehicle to be easily fouled with carbon.

After driving the test vehicle five cycles according to the driving pattern, the insulation resistance and the occurrence rate of inside sparks for each of the sample plugs were evaluated. The higher insulation resistance means that the less carbon flowed into the inside of the air pocket in the spark plug; the lower occurrence rate of inside sparks represents that the better combustion was achieved using the spark plug.

Specifically, the insulation resistance was measured with an insulation resistance meter after completion of five cycles of driving, while the occurrence rate of inside sparks was determined by observing the wave forms of sparks generated during the five cycles of driving.

Figure 3:
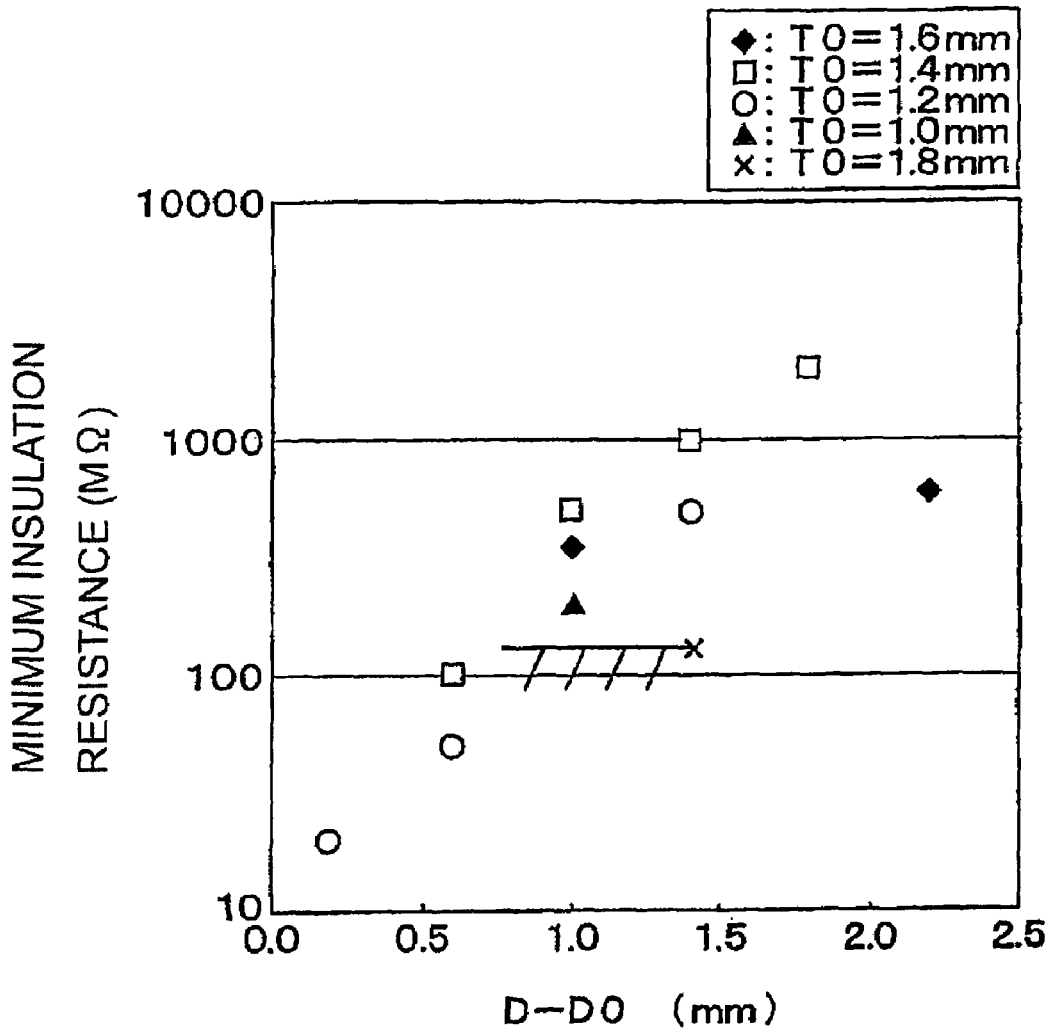
FIG. 3 is a graphical representation showing the relationship between an outer diameter difference (D–D0) and a minimum insulation resistance of the spark plug of FIG. 1, which has a threaded portion with an outer diameter of 10 mm, with respect to different air pocket sizes T0.

FIG. 3 shows the minimum insulation resistance of each of the sample plugs that is measured along the lengthwise direction L of the insulator 20 in the range of the second reference plane 202 to the first reference plane 201.

In the figure, the horizontal axis indicates the outer diameter difference (D−D0), which represents the taper degree of the outer surface of the insulator end portion 24, while the vertical one indicates the resultant minimum insulation resistance with the plot of "◆" for the sample spark plugs of S1 and S2 having the T0 of 1.6 mm, the plot of "□" for the those of S3–S6 having the T0 of 1.4 mm, the plot of "○" for those of S7–S9 having the T0 of 1.2 mm, the plot of "▲" for that of S10 having the T0 of 1.0 mm, and the plot of "X" for that of S11 having the T0 of 1.8 mm, respectively.

Additionally, a boundary line representing the reference insulation resistance of 130 M, which corresponds to the minimum insulation resistance of a sample spark plug having the conventional type S11, is also designated in FIG. 3 for comparative evaluation.

Figure 4:
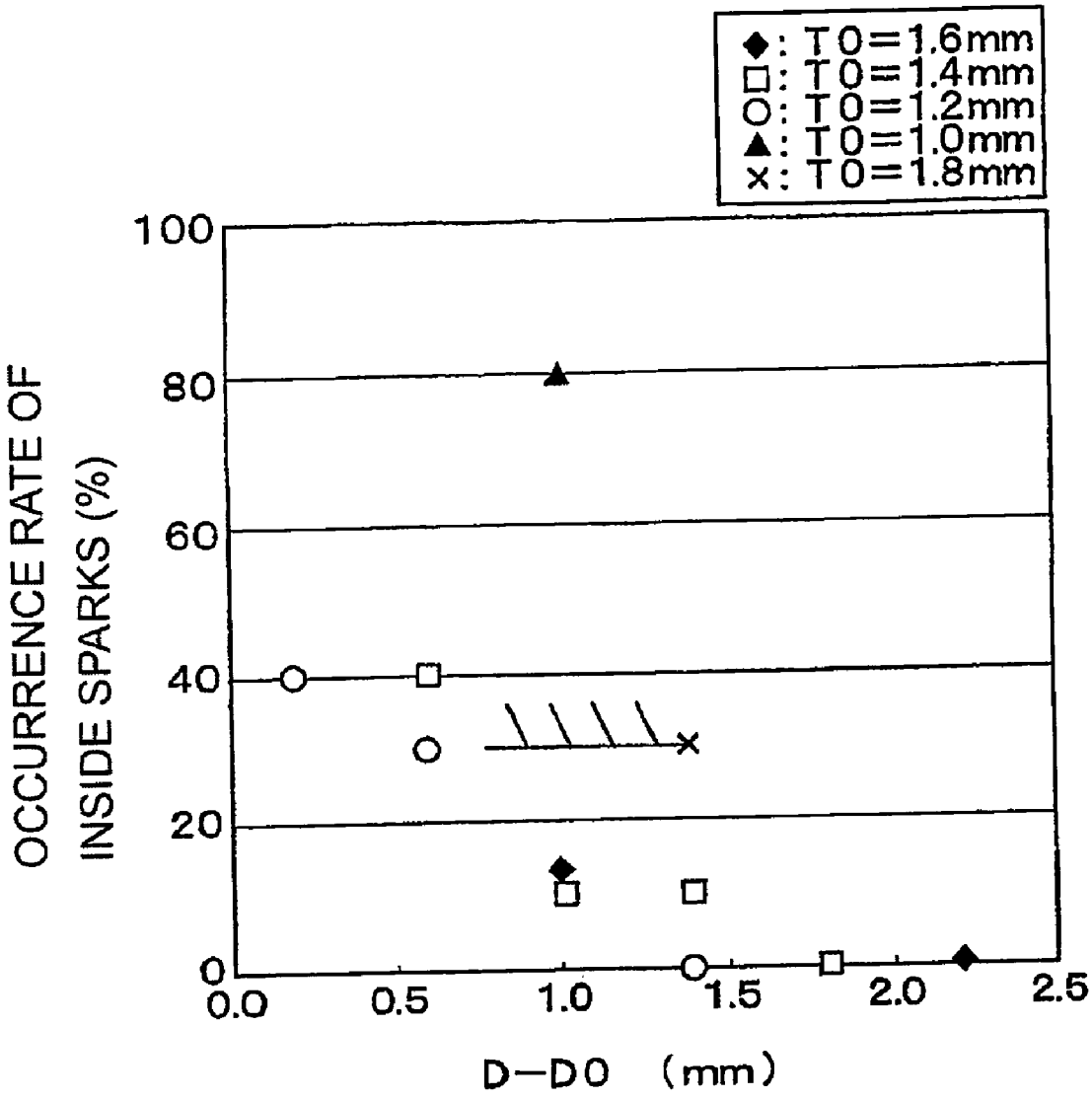
FIG. 4 is a graphical representation showing the relationship between the outer diameter difference (D–D0) and an occurrence rate of inside sparks in the spark plug of FIG. 1, which has the threaded portion with an outer diameter of 10 mm, with respect to different air pocket sizes T0.

FIG. 4 shows the determination results of the occurrence rate of inside sparks with the different sample spark plugs.

In the figure, the horizontal axis indicates the outer diameter difference (D−D0), while the vertical one indicates the resultant occurrence rate of inside sparks with the different plots designating different sample spark plugs in the same way as in FIG. 3. A boundary line representing the reference occurrence rate of inside sparks of 30%, which corresponds to the occurrence rate of inside sparks in the sample spark plug having the conventional type S11, is also designated in FIG. 4 for comparative evaluation.

It can be seen from the FIGS. 3 and 4 that the performance of the sample plug of type S10, which had the air pocket size T0 of 1.0 mm, was inferior to that of the conventional type S11 in both the minimum insulation resistance and the occurrence rate of inside sparks.

Further, it can also be seen from those figures that with any of the sample plugs of S1, S2, S4–S6, and S9, each of which had the air pocket size T0 of not less than 1.2 mm and the outer diameter difference (D−D0) of not less than 1.0 mm, the minimum insulation resistance became higher than the reference value of 130 M and the occurrence rate of inside sparks became lower than the reference value of 30%.

Accordingly, high insulation properties and high ignition capability of the spark plug 100 can be secured through specifying the following relationships between the dimensional parameters D, D0, T0, and G in the spark plug 100:

$D-D0 \geqq 1.0$ mm;

$T0 \geqq 1.2$ mm; and $G \leqq 0.9$ mm.

Further, to completely suppress generation of inside sparks in the spark plug 100, it is preferable that D−D0≧1.5 mm.

In addition, to ensure a high withstand voltage of the spark plug 100, it is required to secure a sufficient radial thickness of the insulator end portion 24. At the same time, the metal shell 10 is also required to have a sufficient radial thickness so as to allow the ground electrode 40 to be joined thereto.

Considering such requirements, it is preferable that the air pocket size T0 of the spark plug 100 is not greater than 1.6 mm.

The above investigation results were obtained with the sample spark plugs 100 that have the threaded portion 11 of the metal shell 10 with an outer diameter of 10 mm. As mentioned previously, the same tendency and similar results have also been obtained through an investigation in which sample spark plugs 100 that have the threaded portion 11 with the outer diameter of 12 mm were tested.

Figure 5:
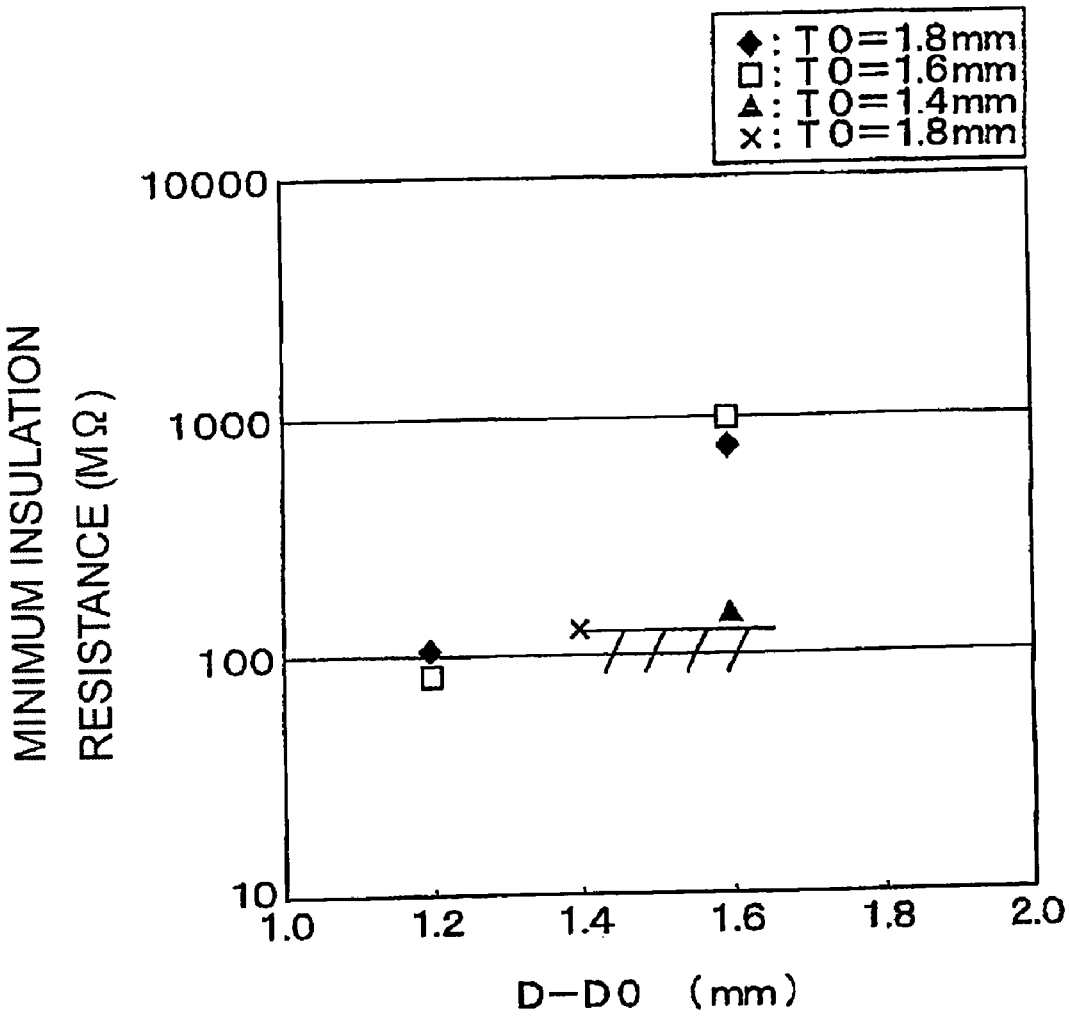
FIG. 5 is a graphical representation showing the relationship between an outer diameter difference (D–D0) and a minimum insulation resistance of the spark plug of FIG. 1, which has a threaded portion with an outer diameter of 12 mm, with respect to different air pocket sizes T0.
Figure 6:
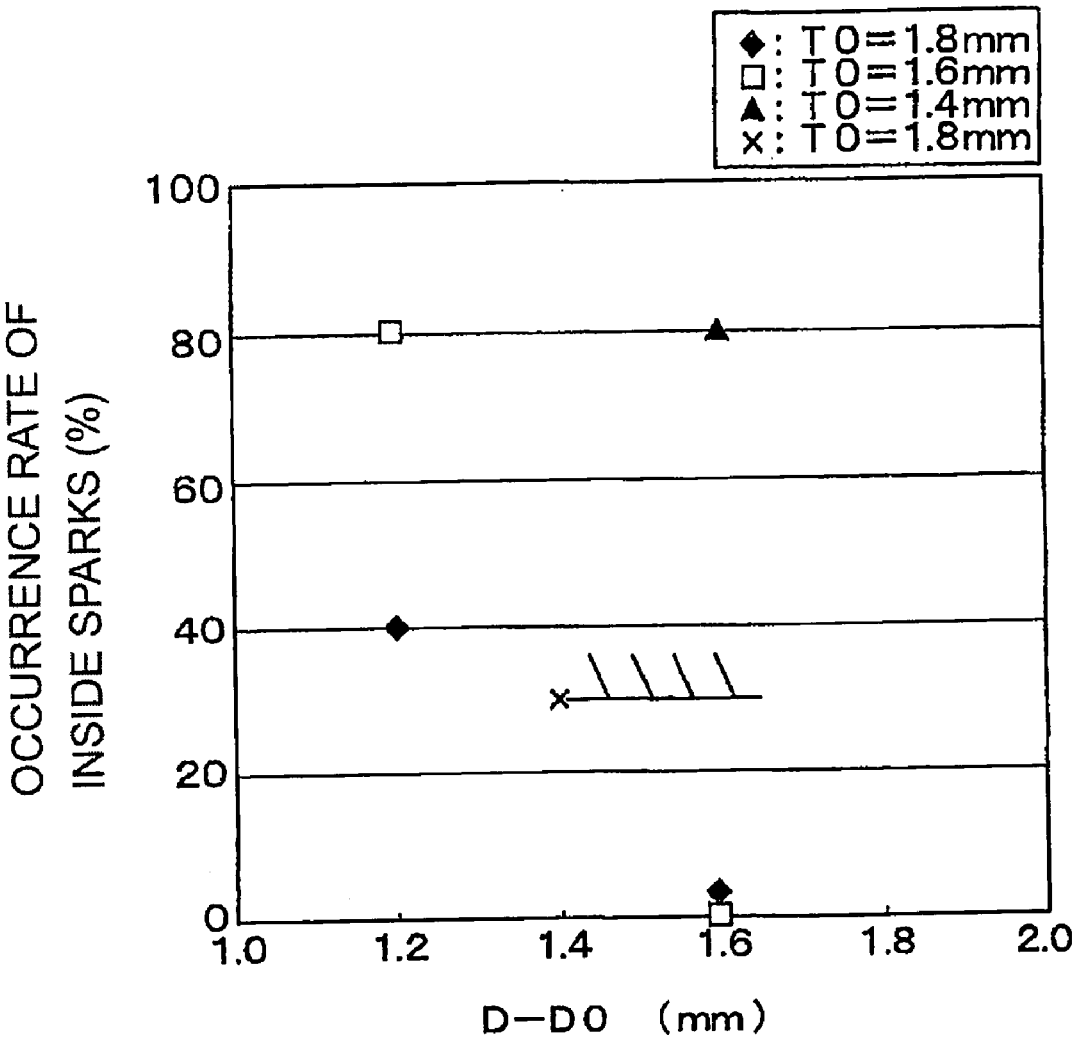
FIG. 6 is a graphical representation showing the relationship between the outer diameter difference (D–D0) and an occurrence rate of inside sparks in the spark plug of FIG. 1, which has the threaded portion with an outer diameter of 12 mm, with respect to different air pocket sizes T0.

FIGS. 5 and 6 show the investigation results. It should be noted that the sample spark plugs tested in the investigation had different air pocket sizes T0 and outer diameter differences (D−D0), but the same spark gap size G of 1.1 mm, which is equal to the spark gap size G of the conventional type S11 described above.

It can be seen from FIGS. 5 and 6 that, to secure high insulation properties and a high ignition capability of the spark plug 100 that has the threaded portion 11 with the outer diameter of 12 mm, the following dimensional relationships are required to be specified for the spark plug 100:

$D-D0 \geqq 1.4$ mm;

$T0 \geqq 1.6$ mm; and $G \leqq 1.1$ mm.

Further, to completely suppress generation of inside sparks in the spark plug 100, it is preferable that D−D0≧1.5 mm.

Turning now to FIGS. 3 and 4, for the sample plugs of S3–S6, which had the same air pocket size T0 of 1.4 mm, the higher minimum insulation resistance and the lower occurrence rate of inside sparks were obtained with the greater outer diameter difference (D−D0).

In order to further investigate the effect of the shape of the outer surface of the insulator end portion 24 on the insulation properties of the spark plug 100, the insulation resistance of the spark plug 100 was measured in more detail.

Specifically, the insulation resistances of the sample spark plugs of S3–S6, all of which had the air pocket size T0 of 1.4 mm and the spark gap size G of 0.9 mm, were measured at 1 mm intervals in the lengthwise direction L of the insulator 20 from the second reference plane 202 in the spark plug.

Figure 7:
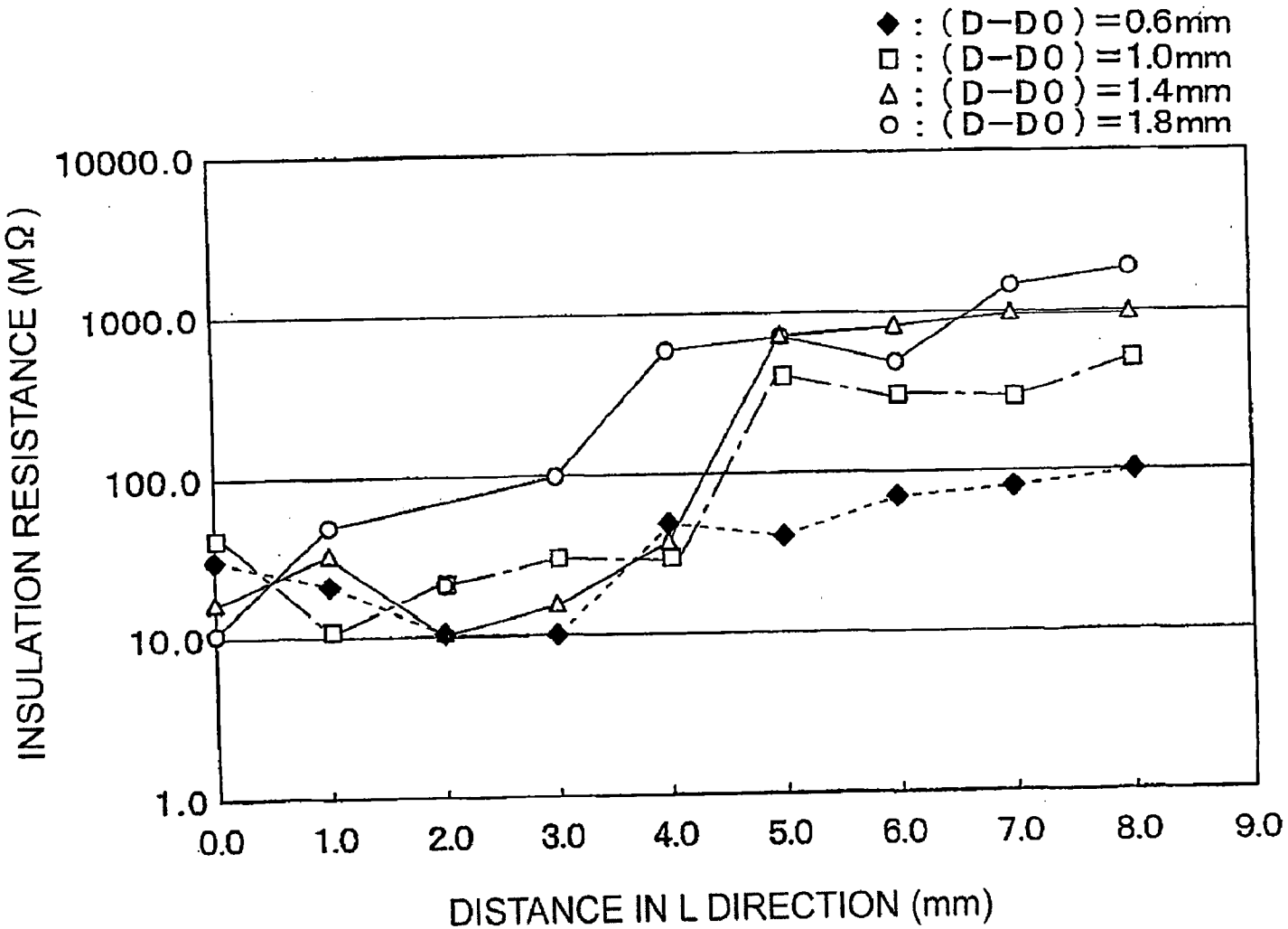
FIG. 7 is a graphical representation showing the change of the insulation resistance of the spark plug of FIG. 1, which has the threaded portion with an outer diameter of 10 mm, in the lengthwise direction of the insulator thereof with respect to different outer diameter differences (D–D0)

FIG. 7 shows the measurement results. In the figure, the horizontal axis indicates the distance of measuring plane from the second reference plane 202 in the lengthwise direction L of the insulator 20, while the vertical one indicates the measured insulation resistance with the plot of "◆" for the sample plug of S3 having the outer diameter difference (D−D0) of 0.6 mm, the plot of "□" for that of S4 having the (D−D0) of 1.0 mm, the plot of "Δ" for that of S5 having the (D−D0) of 1.4 mm, and the plot of "○" for that of S6 having the (D−D0) of 1.8 mm.

As can be seen from FIG. 7, for each of the sample spark plugs, the insulation resistance increases in the lengthwise direction L of the insulator 20; in other words, the insulation resistance could keep the higher value in the deeper place inside the air pocket of the spark plug.

Specifically, in the case of the sample plug of S3 that has the outer diameter difference (D−D0) of less 1.0 mm, the insulation resistance increases very slowly in the lengthwise direction L of the insulator 20. This means that carbon had already flowed into the air pocket of the spark plug deeply and deposited on the outer surface of the insulator end portion 24.

On the contrary, in the case of sample plugs of S4–S6 each having the outer diameter difference (D−D0) of not less than 1 mm, the insulation resistance increases rapidly in the lengthwise direction L of the insulator 20. This means that carbon had not flowed into the air pocket of the spark plug deeply, so that less inside sparks could occur.

Further, in addition to the above sample plugs of S3–S6, the insulation resistance was also measured for sample spark plugs of S2 and S9, at 1 mm intervals in the lengthwise direction L of the insulator 20 from the second reference plane 202.

Figure 8:
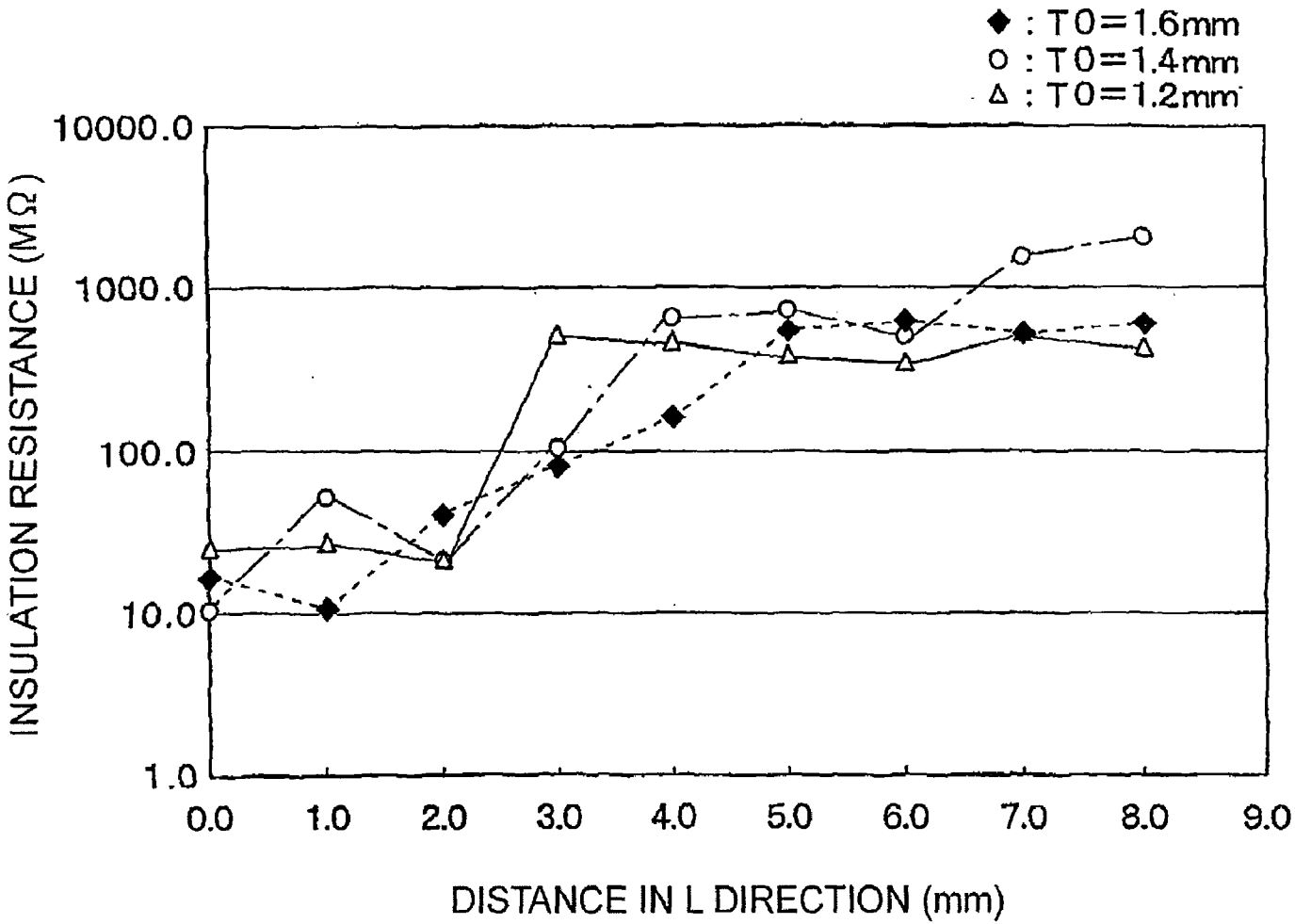
FIG. 8 is a graphical representation showing the change of the insulation resistance of the spark plug of FIG. 1, which has the threaded portion with an outer diameter of 10 mm, in the lengthwise direction of the insulator thereof with respect to different air pocket sizes T0.

FIG. 8 comparatively shows the measurement results with those of the sample plug of S6. In the figure, the horizontal axis indicates the distance of measuring plane from the second reference plane 202 in the lengthwise direction L of the insulator 20, while the vertical one indicates the measured insulation resistance with the plot of "◆" for the sample plug of S2 having the air pocket size T0 of 1.6 mm, the plot of "○" for that of S6 having the T0 of 1.4 mm, and the plot of "Δ" for that of S9 having the T0 of 1.2 mm.

It can be seen from FIG. 8 that, for all of those sample plugs that have different air pocket sizes T0, the insulation resistance increases from the second reference plane 202 and reaches a considerably high level on the measuring plane that is parallel to and spaced 3 mm from the second reference plane 202. In other words, all the area of the outer surface of the insulator end portion 24 spaced more than a distance of 3×T0 in the lengthwise direction L of the insulator 20 from the second reference plane 202 could hardly be fouled with carbon.

Based on the above results, further investigation was directed to determine the suitable range of the taper degree of the outer surface of the insulator end portion 24 in the range from the second reference plane 202 to a third reference plane 203, so as to prevent the occurrence of carbon deposit on the outer surface of the insulator end portion 24. The third reference plane 203 is defined, as shown in FIG. 9, to extend parallel to and spaced the distance of 3×T0 in the lengthwise direction L of the insulator 20 from the second reference plane 202.

Figure 9:
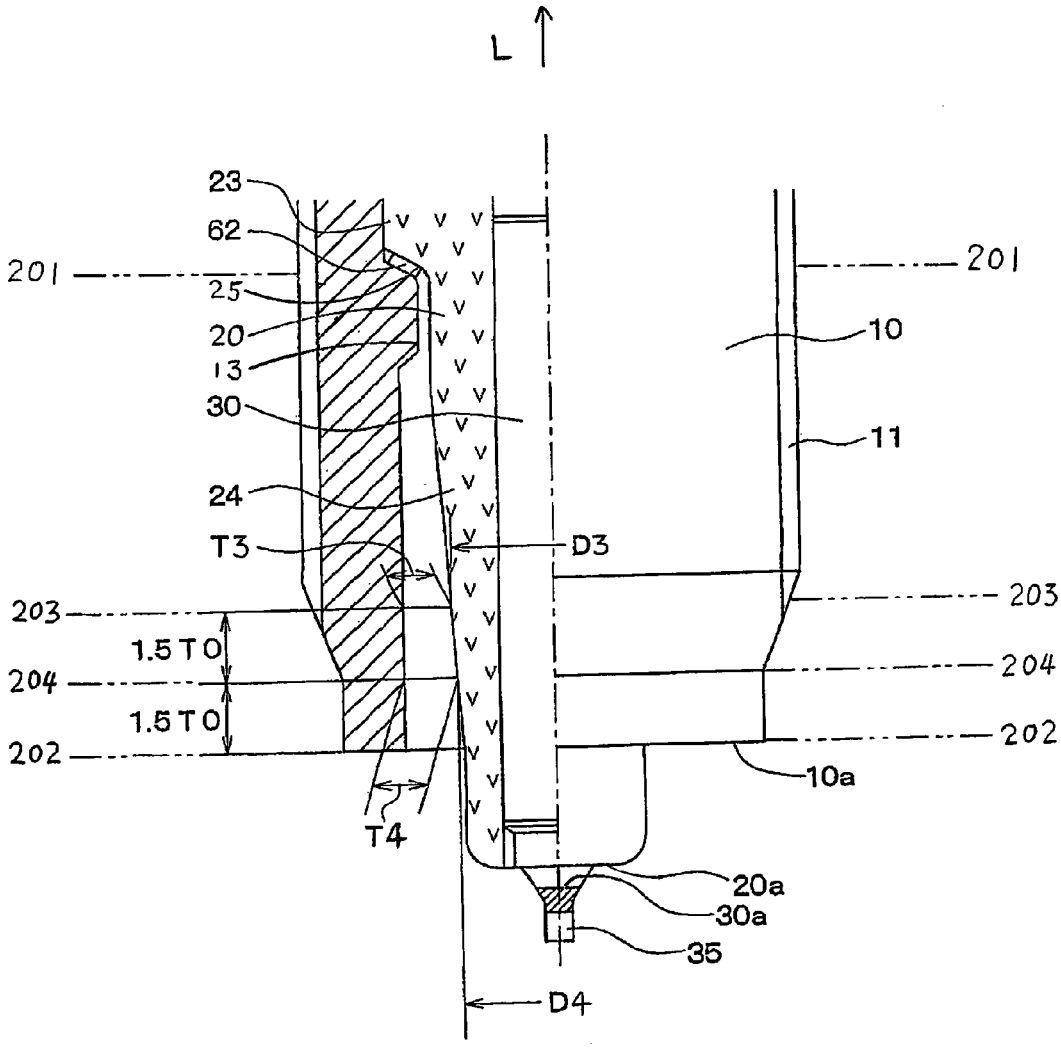
FIG. 9 is an enlarged partially cross-sectional side view illustrating a tapered outer surface of an insulator end portion of the spark plug of FIG. 1 which has the threaded portion with an outer diameter of 10 mm.

In FIG. 9, there is also shown a fourth reference plane 204 that is defined to extend parallel to and spaced a distance of 1.5×T0 in the lengthwise direction L of the insulator 20 from the second reference plane 202. The insulator end portion 24 has an outer diameter D3 and an outer diameter D4 on the third and fourth reference planes 203 and 204 respectively. The distance between the outer surface of the insulator end portion 24 and the inner surface of the metal shell 10 on the third reference plane 203 is designated as T3, while the same on the fourth reference plane 204 is designated as T4.

Accordingly, the taper degree of the outer surface of the insulator end portion 24 in the range from the second reference plane 202 to the third reference plane 203 can be represented by (D3−D0); similarly, the same in the range from the second reference plane 202 to the fourth reference plane 204 can be represented by (D4−D0).

The investigation was conducted using sample spark plugs of seven different types S6 and S61-S66. Those sample spark plugs had the same values for some dimensional parameters, such as the air pocket size T0 of 1.4 mm, the outer diameter D0 of 3.2 mm, the outer diameter D of 5.0 mm, and the spark gap size G of 0.9 mm. At the same time, those sample spark plugs were made different from each other in at least one of the dimensional parameters D3, D4, T3, and T4. The detailed values of those parameters for each sample plug type are given in TABLE 2.

The minimum insulation resistance and the occurrence rate of inside sparks were measured and determined for those sample spark plugs under the same test condition and in the same manner as for the sample spark plugs of S1–S11.

Figure 10:
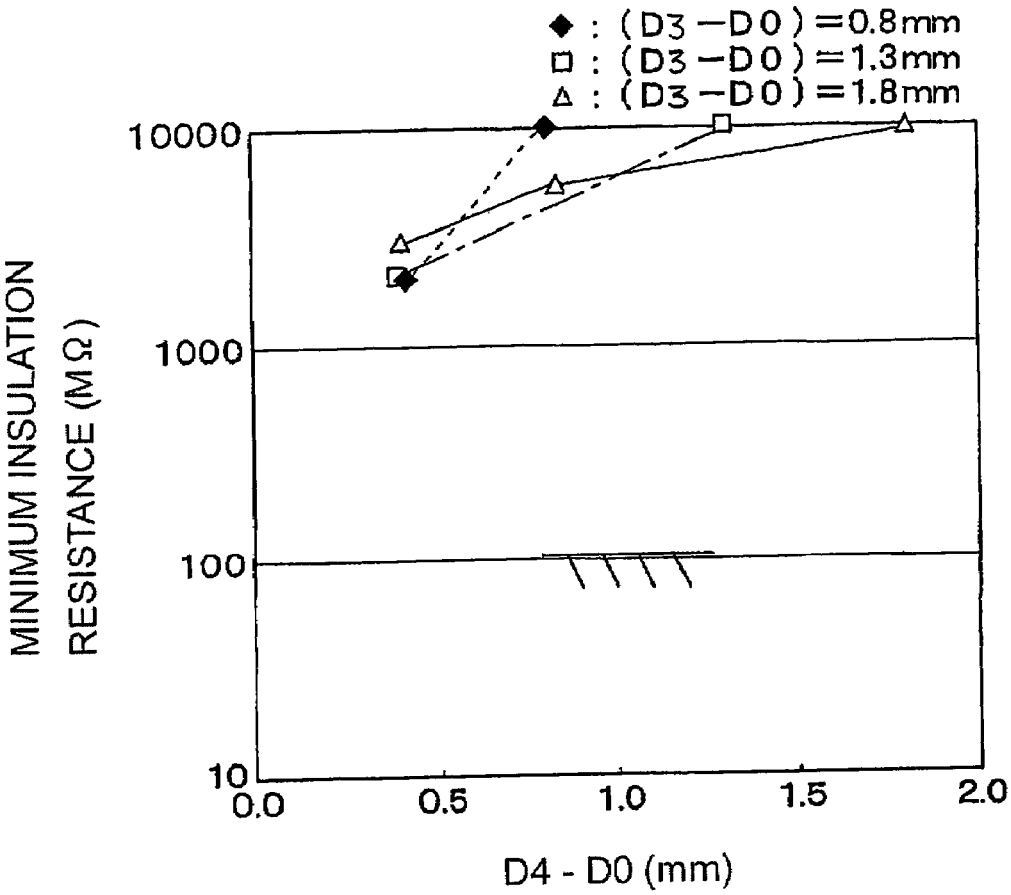
FIG. 10 is a graphical representation showing the relationship between an outer diameter difference (D4–D0) and the minimum insulation resistance of the spark plug of FIG. 1, which has the threaded portion with an outer diameter of 10 mm, with respect to different outer diameter differences (D3–D0)

FIG. 10 shows the measurement results of the minimum insulation resistance with those sample spark plugs.

In the figure, the horizontal axis indicates the outer diameter difference (D4−D0), while the vertical one indicates the resultant minimum insulation resistance with the plot of "◆" for the sample plugs of S6 and S63 having the outer diameter difference (D3−D0) of 0.8 mm, the plot of "□" for those of S61 and S65 having the (D3−D0) of 1.3 mm, and the plot of "Δ" for those of

TABLE 2

(UNIT: mm)

| TYPE | D0 | D3 | D3−D0 | D4 | D4−D0 | T3 | T4 |
|---|---|---|---|---|---|---|---|
| S6 | 3.20 | 4.00 | 0.80 | 3.60 | 0.40 | 1.00 | 1.20 |
| S61 | 3.20 | 4.50 | 1.30 | 3.60 | 0.40 | 0.75 | 1.20 |
| S62 | 3.20 | 5.00 | 1.80 | 3.60 | 0.40 | 0.50 | 1.20 |
| S63 | 3.20 | 4.00 | 0.80 | 4.00 | 0.80 | 1.00 | 1.00 |
| S64 | 3.20 | 5.00 | 1.80 | 4.00 | 0.80 | 0.50 | 1.00 |
| S65 | 3.20 | 4.50 | 1.30 | 4.50 | 1.30 | 0.75 | 0.75 |
| S66 | 3.20 | 5.00 | 1.80 | 5.00 | 1.80 | 0.50 | 0.50 |

S62, S64, and S66 having the (D3−D0) of 1.8 mm, respectively.

Additionally, a boundary line representing the reference insulation resistance of 130 M is also designated in FIG. 10 for comparative evaluation.

As can be seen from FIG. 10, all the sample spark plugs exhibit more excellent insulation performance than the sample plug of the conventional type S11, the minimum insulation resistance of which is adopted as the reference value of 130 M.

Figure 11:
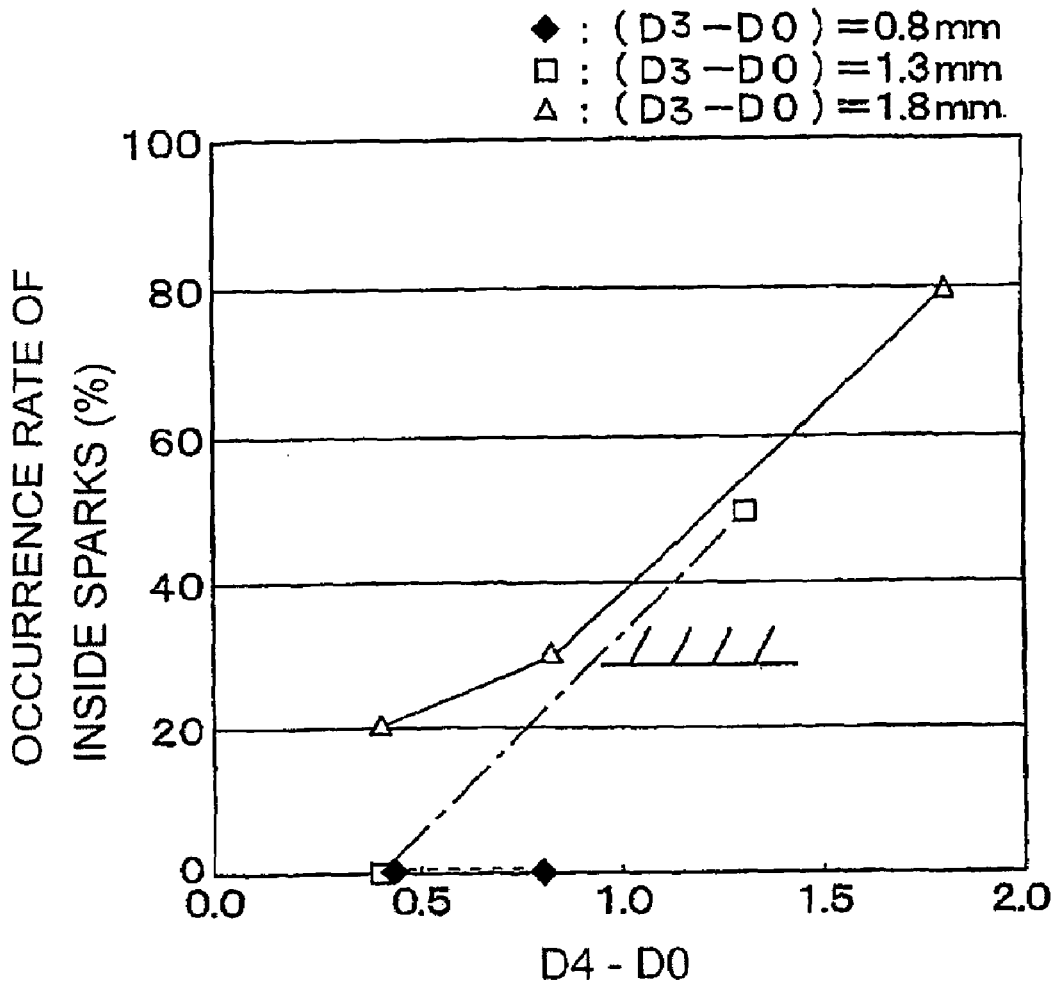
FIG. 11 is a graphical representation showing the relationship between the outer diameter difference (D4–D0) and the occurrence rate of inside sparks in the spark plug of FIG. 1, which has the threaded portion with an outer diameter of 10 mm, with respect to different outer diameter differences (D3–D0)

FIG. 11 shows the determination results of the occurrence rate of inside sparks with those sample spark plugs.

In the figure, the horizontal axis indicates the outer diameter difference (D4−D0), while the vertical one indicates the resultant occurrence rate of inside sparks with the different plots designating different sample plugs in the same way as in FIG. 10. A boundary line representing the reference occurrence rate of inside sparks of 30% is also designated in FIG. 11 for comparative evaluation.

As can be seen from FIG. 11, the occurrence rate of inside sparks exceeds the reference value of 30% in the sample plugs of S64–S66, each of which had both a large (D3−D0) and a large (D4−D0). This is because when the outer diameters D3 and D4 are large, the distances T3 and T4 between the outer surface of the insulator end portion 24 and the inner surface of the metal shell 10 accordingly become small, thus causing more inside sparks in the spark plug.

Accordingly, it was made clear from the investigation results shown in FIGS. 10 and 11 that, for the spark plug 100, the outer diameter difference (D3−D0) is preferably not greater than 1.8 mm and the outer diameter difference (D4−D0) is preferably not greater than 0.8 mm, so as to secure sufficient insulation resistance and to effectively suppress generation of inside sparks.

In addition, when the outer diameter D3 is made greater than the outer diameter D in the insulator end portion 24, it becomes impossible to install the insulator 20 into the metal shell 10. Therefore, it is necessary for the spark plug 100 to satisfy the dimensional relationship of $D3 \leqq D$.

Moreover, it is preferable for the spark plug 100 that the outer diameter difference (D3−D0) is not less than 1.0 mm, thereby allowing the previously-specified dimensional relationship of $D-D0 \geqq 1.0$ mm to be definitely satisfied (since $D3 \leqq D$).

Accordingly, in addition to the dimensional relationships specified previously, it is preferable to further specify the following relationships for the spark plug 100:

$$1.0\ \text{mm} \leqq D3-D0 \leqq 1.8\ \text{mm};\ \text{and}$$

$$D4-D0 \leqq 0.8\ \text{mm}.$$

Besides the effect of the shape of the outer surface of the insulator end portion 24, the inventors have also investigated the effect of the shape of the inner surface of the metal shell 10 on the insulation resistance and the occurrence rate of inside sparks of the spark plug 100.

Sample spark plugs of a type S67, which is designed on the basis of the above-described type of S61, were fabricated for the investigation. The detailed values of dimensional parameters for the sample plug type S67 are given in TABLE 3, while the end portions of the metal shell 10 and the insulator 20 of a sample spark plug that has the type of S67 are shown in FIG. 12.

Figure 12:
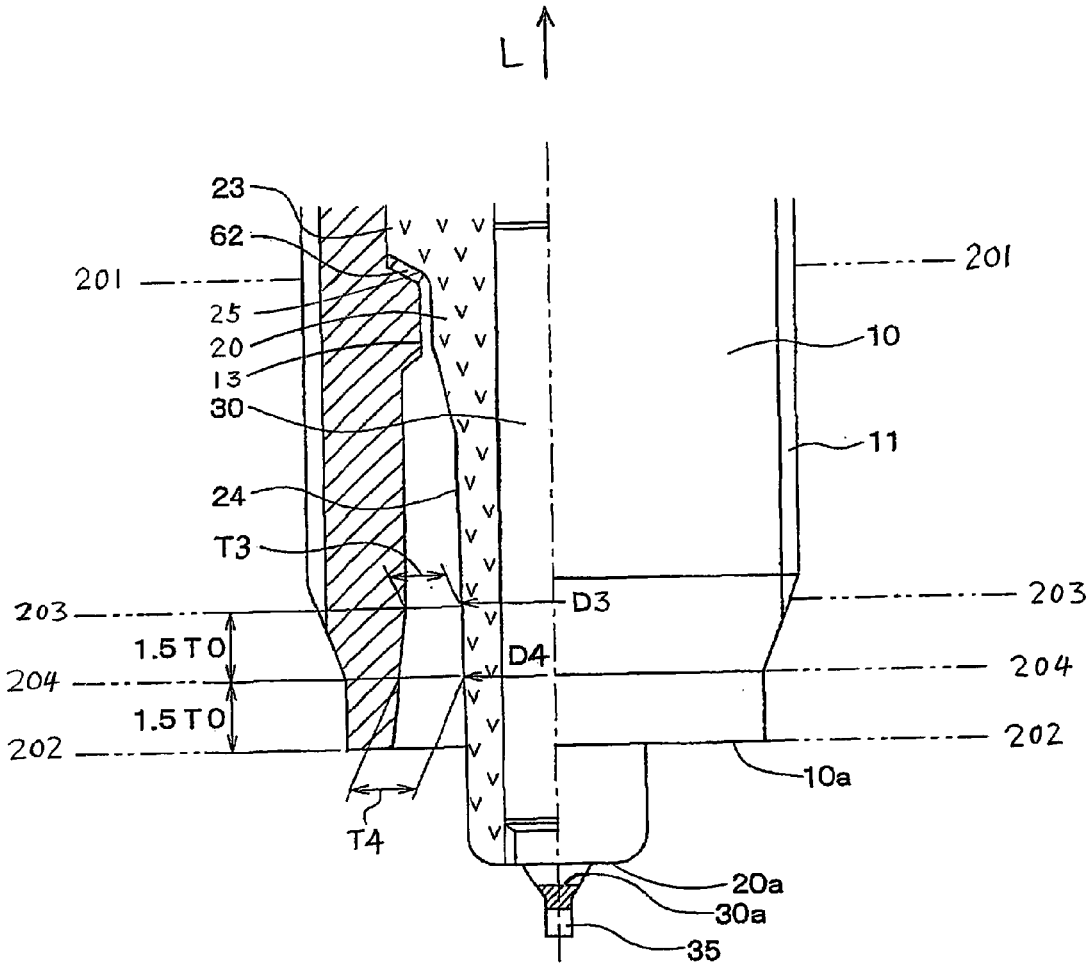
FIG. 12 is an enlarged partially cross-sectional side view illustrating a tapered inner surface of a metal shell of a spark plug that has a threaded portion with an outer diameter of 10 mm.

In the sample spark plug, the inner diameter of the metal shell 10 decreases, as shown in FIG. 12, from the second reference plane 202 that includes the end 10*a* of the metal shell 10 to the third reference plane 203 in the lengthwise direction L of the insulator 20. In other words, the inner surface of the metal shell 10 is tapered in the range of the second reference plane 202 to the third reference plane 203. At the same time, the taper degree of the outer surface of the insulator end portion 24 is equal to zero in the same range of from the second reference plane 202 to the third reference plane 203.

TABLE 3

(UNIT: mm)

| TYPE | D3 | D4 | T3 | T4 |
|---|---|---|---|---|
| S67 | 3.2 | 3.2 | 0.8 | 1.2 |

More specifically, the sample plug type of S67 is designed to have the same values of T3 and T4, which are the distances between the inner surface of the metal shell 10 and the outer surface of the insulator end portion 24 on the third reference plane 203 and the fourth reference plane 204 respectively, as the prototype of S61 by tapering the inner surface of the metal shell 10 instead of the outer surface of the insulator end portion 24.

The minimum insulation resistance and the occurrence rate of inside sparks were measured and determined for the sample spark plug of S67 under the same test condition and in the same manner as for sample spark plugs of other types described above.

Figure 13:
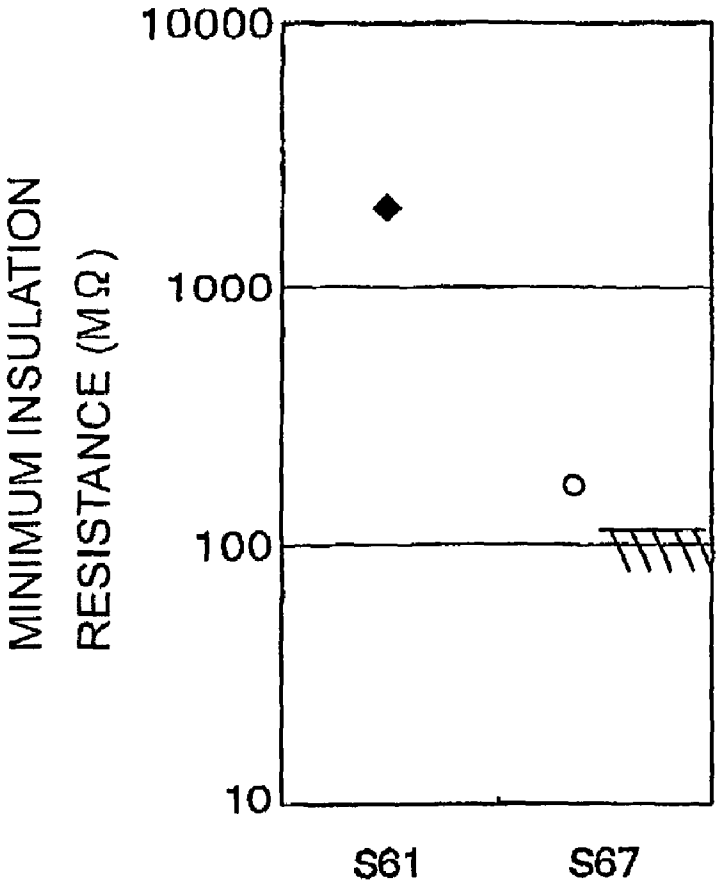
FIG. 13 is a graphical representation showing a minimum insulation resistance of the spark plug of FIG. 12 in comparison with that of the spark plug of FIG. 1.

FIG. 13 shows the measured minimum insulation resistance of the sample spark plug of S67 in comparison with that of a sample spark plug of S61. In the figure, the plot of "◆" designates the minimum insulation resistance of the sample plug of S61, while the plot of "○" designates the same of the sample plug of S67. In addition, a boundary line representing the reference insulation resistance of 130 M is also designated in the same figure.

As can be seen from FIG. 13, the sample spark plug of S67 has a minimum insulation resistance higher than the reference insulation resistance but considerably lower that of the sample spark plug of S61.

Figure 14:
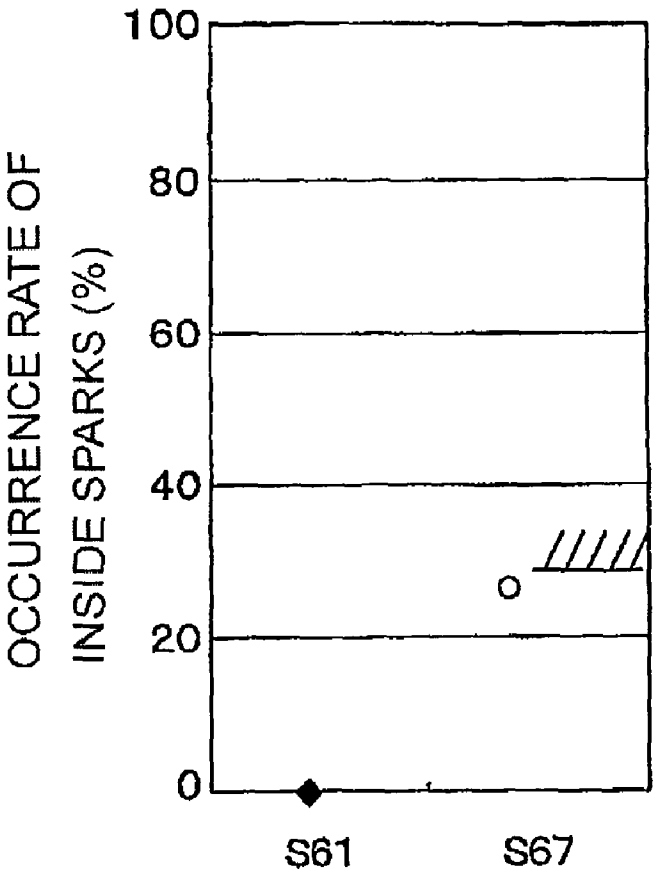
FIG. 14 is a graphical representation showing an occurrence rate of inside sparks in the spark plug of FIG. 12 in comparison with that in the spark plug of FIG. 1.

FIG. 14 shows the determined occurrence rate of inside sparks of the sample spark plug of S67 in comparison with that of the sample spark plug of S61. In the figure, the different plots designate the values of the two sample spark plugs in the same way as in FIG. 13. A boundary line representing the reference value of 30% is also designated in the same figure.

As can be seen from FIG. 14, the sample plug of S67 has an occurrence rate of inside sparks lower than the reference value of 30% but considerably higher than that of the sample plug of S61, which is equal to zero.

Accordingly, though the two sample spark plugs have the same values of T3 and T4, the performance of the sample plug of S67 in insulation properties and in ignition capability becomes inferior to that of the sample plug of S61.

This may attribute to the fact that, in the case of the sample plug of S67, the carbon flowing into the air pocket will collide against the tapered inner surface of the metal shell 10 and change the flow course to toward the outer surface of the insulator end portion 24, thus becoming easier to deposit on that outer surface.

Therefore, it is preferable for the spark plug 100 that the inner diameter of the metal shell 10 is constant, or increases along the lengthwise direction L of the insulator 20 in the range from the second reference plane 202 to the third reference plane 203.

To sum up, the spark plug 100 according to the invention has an improved structure characterized in that the dimensional parameters including the spark gap size G, the outer diameters D and D0 of the end portion 24 of the insulator 20 on the first and second reference planes 201 and 202, and the air pocket size T0 satisfy the following dimensional relationships:

If the outer diameter of the threaded portion 11 of the metal shell 10 is equal to or less than 10 mm, then $$D-D0 \geqq 1.0 \text{ mm};$$

$$T0 \geqq 1.2 \text{ mm; and}$$

$$G \leqq 0.9 \text{ mm}.$$

Else if the outer diameter of the threaded portion 11 is equal to 12 mm, then $$D-D0 \geqq 1.4 \text{ mm};$$

$$T0 \geqq 1.6 \text{ mm; and}$$

$$G \leqq 1.1 \text{ mm}.$$

The improved structure ensures the spark plug 100 of high insulation properties and a high ignition capability.

[Other Embodiments]

While the above particular embodiments of the invention have been shown and described, it will be understood by those who practice the invention and those skilled in the art that various modifications, changes, and improvements may be made to the invention without departing from the spirit of the disclosed concept.

For example, in the previous embodiments, the first and second noble metal chips 35 and 45 are joined to the center and ground electrodes 30 and 40, respectively, by laser welding.

However, other joining means may also be used, such as resistance welding, plasma welding, and adhesive joining.

Moreover, the two noble metal chips 35 and 45, which have a cylindrical shape in the previous embodiments, may also have a prismatic shape.

Furthermore, the center electrode 30 and the ground electrode 40 may not include the two noble metal chips 35 and 45 respectively.

In addition, except the essential dimensional relationships specified in the previous embodiments, other detailed dimensional ranges and/or relationships may be suitably modified, or changed in designing the spark plug 100.

Such modifications, changes, and improvements within the skill of the art are intended to be covered by the appended claims.

What is claimed is:

1. A spark plug comprising:

a tubular metal shell having a first end and a second end opposed to the first end, said metal shell also having a threaded portion on an outer periphery thereof and an annular seat formed on an inner surface of said metal shell, the threaded portion having an outer diameter of 10 mm or less;

a hollow insulator having a length with a first length portion, a second length portion, and a shoulder provided between the first and second length portions, the shoulder having an outer surface that tapers and continues to an outer surface of the first length portion, said insulator being fixed in said metal shell such that the shoulder of said insulator and the annular seat of said metal shell are in sealing engagement through a gasket, the first length portion of said insulator having an end protruding from the first end of said metal shell;

a center electrode secured in said insulator, said center electrode having an end protruding from the end of the first length portion of said insulator; and a ground electrode joined to the first end of said metal shell, said ground electrode having a tip portion that faces the end of said center electrode through a spark gap, wherein the first length portion of said insulator tapers toward the end thereof to have a first outer diameter on a first reference plane and a second outer diameter on a second reference plane, the first reference plane being defined to extend perpendicular to a lengthwise direction of said insulator through an intersection between a first reference straight-line having a section on the outer surface of the shoulder and a second reference straight-line having a section on the outer surface of the first length portion of said insulator, the second reference straight-line being so defined that the first length portion of said insulator has a maximum outer diameter on the section of the second reference straight-line, the second reference plane being defined to extend parallel to the first reference plane through an inner edge of the first end of said metal shell, wherein the following dimensional relationships are defined:

$$D-D0 \geqq 1.0 \text{ mm};$$

$$T0 \geqq 1.2 \text{ mm};$$

$$G \leqq 0.9 \text{ mm; and}$$

$$D4-D0 \geqq 0.8 \text{ mm, where}$$

D is the first outer diameter of the first length portion of said insulator on the first reference plane, D0 is the second outer diameter of the first length portion of said insulator on the second reference plane, T0 is a distance between the inner surface of said metal shell and the outer surface of said insulator on the second reference plane, G is a space of the spark gap between the end of said center electrode and the tip portion of said ground electrode, and D4 is an outer diameter of the first length portion of said insulator on a fourth reference plane that is defined to extend parallel to and spaced a distance of 1.5×T0 from the second reference plane.

2. The spark plug as set forth in claim 1, wherein the following dimensional relationship is defined:

$$D-D0 \geqq 1.5 \text{ mm.}$$

3. The spark plug as set forth in claim 1, wherein the following dimensional relationship is defined:

$$1.0 \text{ mm} \leqq (D3-D0) \leqq 1.8 \text{ mm,}$$

where D3 is an outer diameter of the first length portion of said insulator on a third reference plane that is defined to extend parallel to and spaced a distance of 3×T0 from the second reference plane.

4. The spark plug as set forth in claim 1, wherein the threaded portion of said metal shell has an outer diameter equal to 10 mm.

5. The spark plug as set forth in claim 1, wherein an inner diameter of said metal shell is constant along the lengthwise direction of said insulator in a range from the second reference plane to the third reference plane that is defined to extend parallel to and spaced a distance of 3×T0 from the second reference plane.

6. The spark plug as set forth in claim 1, wherein an inner diameter of said metal shell increases along the lengthwise direction of said insulator in a range from the second reference plane to the third reference plane that is defined to extend parallel to and spaced a distance of 3×T0 from the second reference plane.

7. The spark plug as set forth in claim 1, wherein said center electrode comprises a noble metal chip, an end of which represents the end of the center electrode, and wherein the noble metal chip of said center electrode has a cross-sectional area perpendicular to the lengthwise direction of said insulator in a range of 0.07 to 0.40 $mm^2$.

8. The spark plug as set forth in claim 7, wherein the noble metal chip of said center electrode is made of an Ir-based alloy including Ir in an amount of greater than 50 weight percent and at least one additive, the Ir-based alloy having a melting point of greater than 2000 degrees Celsius.

9. The spark plug as set forth in claim 8, wherein the at least one additive is selected from Pt, Rh, Ni, W, Pd, Ru, Re, Al, $Al_2O_3$, Y, $Y_2O_3$.

10. The spark plug as set forth in claim 1, wherein the tip portion of said ground electrode includes a noble metal chip that has a cross-sectional area perpendicular to the lengthwise direction of said insulator in a range of 0.12 to 0.80 $mm^2$, and a length in the lengthwise direction of said insulator in a range to 0.3 to 1.5 mm, and wherein the following dimensional relationship is defined:

$$G \geqq 0.6 \text{ mm.}$$

11. The spark plug as set forth in claim 10, wherein the noble metal chip of said ground electrode is made of a Pt-based alloy including Pt in an amount of greater than 50 weight percent and at least one additive, the Pt-based alloy having a melting point of greater than 1500 degrees Celsius.

12. The spark plug as set forth in claim 11, wherein the at least one additive is selected from Ir, Rh, Ni, W, Pd, Ru, Re.

13. The spark plug as set forth in claim 1, wherein a distance between the first and the second reference planes in the lengthwise direction of said insulator is in a range of 10 to 15 mm.

14. The spark plug as set forth in claim 13, the distance between the first and the second reference planes in the lengthwise direction of said insulator is equal to 11 mm.

15. A spark plug comprising:

a tubular metal shell having a first end and a second end opposed to the first end, said metal shell also having a threaded portion on an outer periphery thereof and an annular seat formed on an inner surface of said metal shell, the threaded portion having an outer diameter of 12 mm;

a hollow insulator having a length with a first length portion, a second length portion, and a shoulder provided between the first and second length portions, the shoulder having an outer surface that tapers and continues to an outer surface of the first length portion, said insulator being fixed in said metal shell such that the shoulder of said insulator and the annular seat of said metal shell are in sealing engagement through a gasket, the first length portion of said insulator having an end protruding from the first end of said metal shell;

a center electrode secured in said insulator, said center electrode having an end protruding from the end of the first length portion of said insulator; and a ground electrode joined to the first end of said metal shell, said ground electrode having a tip portion that faces the end of said center electrode through a spark gap, wherein the first length portion of said insulator tapers toward the end thereof to have a first outer diameter on a first reference plane and a second outer diameter on a second reference plane, the first reference plane being defined to extend perpendicular to a lengthwise direction of said insulator through an intersection between a first reference straight-line having a section on the outer surface of the shoulder and a second reference straight-line having a section on the outer surface of the first length portion of said insulator, the second reference straight-line being so defined that the first length portion of said insulator has a maximum outer diameter on the section of the second reference straight-line, the second reference plane being defined to extend parallel to the first reference plane through an inner edge of the first end of said metal shell, wherein the following dimensional relationships are defined:

$$D-D0 \geqq 1.4 \text{ mm};$$

$$T0 \geqq 1.6 \text{ mm};$$

$$G \leqq 1.1 \text{ mm; and}$$

$$D4-D0 \leqq 0.8 \text{ mm, where}$$

D is the first outer diameter of the first length portion of said insulator on the first reference plane, D0 is the second outer diameter of the first length portion of said insulator on the second reference plane, T0 is a distance between the inner surface of said metal shell and the outer surface of said insulator on the second reference plane, and G is a space of the spark gap between the end of said center electrode and the tip portion of said ground electrode, and D4 is an outer diameter of the first length portion of said insulator on a fourth reference plane that is defined to extend parallel to and spaced a distance of 1.5×T0 from the second reference plane.

16. The spark plug as set forth in claim 15, wherein the following dimensional relationship is defined:

$$D-D0 \geqq 1.6 \text{ mm}.$$

17. The spark plug as set forth in claim 15, wherein an inner diameter of said metal shell is constant along the lengthwise direction of said insulator in a range from the second reference plane to the third reference plane that is defined to extend parallel to and spaced a distance of 3×T0 from the second reference plane.

18. The spark plug as set forth in claim 15, wherein an inner diameter of said metal shell increases along the lengthwise direction of said insulator in a range from the second reference plane to the third reference plane that is defined to extend parallel to and spaced a distance of 3×T0 from the second reference plane.

19. The spark plug as set forth in claim 15, wherein said center electrode comprises a noble metal chip, an end of which represents the end of the center electrode, and wherein the noble metal chip of said center electrode has a cross-sectional area perpendicular to the lengthwise direction of said insulator in a range of 0.07 to 0.40 $mm^2$.

20. The spark plug as set forth in claim 19, wherein the noble metal chip of said center electrode is made of an Ir-based alloy including Ir in an amount of greater than 50 weight percent and at least one additive, the Ir-based alloy having a melting point of greater than 2000 degrees Celsius.

21. The spark plug as set forth in claim 20, wherein the at least one additive is selected from Pt, Rh, Ni, W, Pd, Ru, Re, Al, $Al_2O_3$, Y, $Y_2O_3$.

22. The spark plug as set forth in claim 15, wherein the tip portion of said ground electrode includes a noble metal chip that has a cross-sectional area perpendicular to the lengthwise direction of said insulator in a range of 0.12 to 0.80 $mm^2$, and a length in the lengthwise direction of said insulator in a range of 0.3 to 1.5 mm, and wherein the following dimensional relationship is defined:

$$G \geqq 0.6 \text{ mm}.$$

23. The spark plug as set forth in claim 22, wherein the noble metal chip of said ground electrode is made of a Pt-based alloy including Pt in an amount of greater than 50 weight percent and at least one additive, the Pt-based alloy having a melting point of greater than 1500 degrees Celsius.

24. The spark plug as set forth in claim 23, wherein the at least one additive is selected from Ir, Rh, Ni, W, Pd, Ru, Re.

* * * * *